United States Patent [19]

Devine

[11] 4,288,176

[45] Sep. 8, 1981

[54] UNDERWATER AIR POCKET WORK UNIT

[76] Inventor: Thomas H. Devine, 147 Jefferson Ave., Chula Vista, Calif. 92012

[21] Appl. No.: 23,329

[22] Filed: Mar. 23, 1979

[51] Int. Cl.[3] ..... B63L 11/10

[52] U.S. Cl. ..... 405/188; 405/11; 114/222; 114/315; 114/125

[58] Field of Search ..... 405/11-14, 405/168-170, 188, 189, 192-194; 114/125, 222, 270, 227, 228, 322-325, 315

[56] References Cited

U.S. PATENT DOCUMENTS 1,619,642 3/1927 Ward ..... 405/192
3,857,249 12/1974 Kelly ..... 114/227

FOREIGN PATENT DOCUMENTS 1221773 2/1971 United Kingdom ..... 405/12

*Primary Examiner*—Trgyve M. Blix
*Assistant Examiner*—D. W. Keen
*Attorney, Agent, or Firm*—Brown & Martin

[57] ABSTRACT

An underwater air pocket work unit has a work chamber contained within a double walled flotation chamber, the upper end of which has a resilient gasket to seal against the hull of a vessel, or other submerged structure. The work chamber is open completely through the structure to provide unobstructed access at both ends and the flotation chamber is open at the lower end. Valves are provided for admitting pressurized air to the flotation chamber to control the buoyancy for holding the structure in place, and for admitting air to the work chamber as necessary for working space. Both chambers have dump valves for releasing the air and the work chamber has window ports for holding work lights. Vent ports extend through side walls of the work chamber for enabling air to flow from the work chamber into the water outside the work chamber to thereby limit the maximum depth of the air pocket to enable a workman floating at the water surface in the work chamber to comfortably reach an overhead underwater work surface on the hull of the vessel.

10 Claims, 3 Drawing Figures

UNDERWATER AIR POCKET WORK UNIT

BACKGROUND OF THE INVENTION

It is often necessary to perform maintenance on portions of vessels which are underwater. As an example, when a vessel is in dry dock the keel rests on keel blocks, which remain in place until the vessel is refloated. The areas covered by the keel blocks must then be cleaned, painted, or otherwise treated to prevent the spread of corrosion. There are many other tasks, such as welding, carried out on vessels and other submerged structures, which require the provision of an air or other gas filled work chamber around the area being serviced. As used herein, the term "gas" includes air and other gases.

Many different types of air chambers, habitats, cofferdams and the like have been devised. Most of these must be clamped, tied, or otherwise secured to the work area, which can be difficult to do on a large vessel. Some devices are very complex and expensive for the simple purpose that they serve.

SUMMARY OF THE INVENTION

The present invention is an underwater gas pocket work unit including a structure having side walls with opposite first and second ends defining a work chamber, wherein the work chamber is defined solely by the side walls to provide unobstructed access to the work chamber at both ends; a gasket for sealing the first end of the structure to an underwater work surface; and a valve in the structure for enabling a gas to enter the work chamber to provide a gaseous pocket in the upper portion of the work chamber when the first end of the structure is sealed to the underwater work surface. Preferably, the unit further includes a vent port in at least one of the side walls more remote from the first end than the valve, for enabling gas to flow from the gaseous pocket into the water outside the work chamber when the first end of the structure is sealed to the underwater work surface to thereby limit the maximum depth of the gas pocket to enable a workman floating at the water surface in the work chamber to comfortably reach the underwater work surface when the underwater work surface is overhead.

The preferred embodiment of the underwater work unit described herein is a very simple structure with a double walled flotation chamber surrounding a work chamber, which is open at the top and bottom. The upper end of the work chamber has a resilient gasket to seal against the hull of a vessel, or other surface, the unit being held in place by buoyancy of air in the flotation chamber. Valves are provided to admit air to the flotation chamber to displace water, the lower end of the flotation chamber being open to the water, and to the work chamber to provide the necessary air pocket. The open structure avoids the necessity for stressing to withstand water pressure and eliminates many sealing problems which are present in other chamber units. This is distinct from a cofferdam which is designed to keep water out of an area, such as when an opening is made through a hull below the water line.

Dump valves allow the release of air from the work and flotation chambers and the work chamber is vented to control the maximum size of the air pocket, to ensure that the worker can reach the work area while floating in the water. The flotation chamber has sockets with internal windows to hold underwater lights for illuminating the work area.

The primary object of this invention, therefore, is to provide a new and improved underwater air pocket work unit.

Another object of this invention is to provide an underwater work unit which is held in place by buoyancy of air trapped in a flotation chamber.

Another object of this invention is to provide an underwater work unit in which the work area is completely open to the water and contains an air pocket in which a diver can work.

A further object of this invention is to provide an underwater work unit which is easy to handle and set up and requires no special retaining means or supports.

Other objects and advantages will be apparent in the following detailed description, taken in conjunction with the accompanying drawing, in which.

DESCRIPTION OF THE PREFERRED EMBODIMENT

Figure 1:
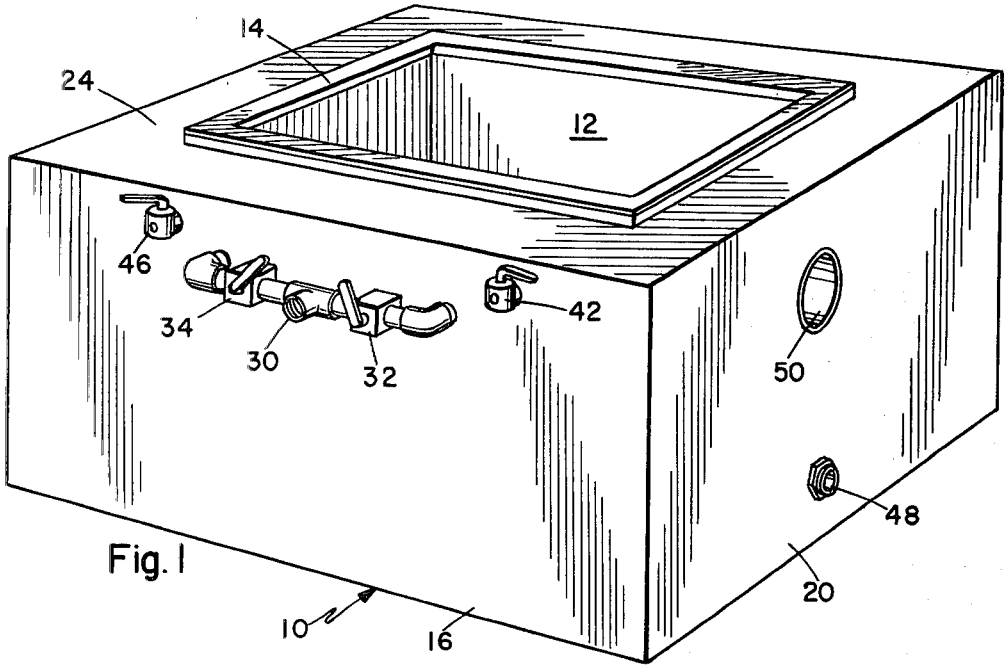
FIG. 1 is a perspective view of the complete structure.

The unit comprises basically a double walled flotation chamber 10 surrounding an open work chamber 12. Extending completely around the upper end of the work chamber 12 is a resilient gasket 14, of Neoprene or the like. As illustrated the structure is of simple rectangular box configuration, but could be of any suitable shape. Also, the gasket could be shaped to fit a curved hull if necessary to ensure a good seal. The structure can be made of various materials, such as marine plywood, plastic, metal, or combinations of materials, depending on the size and particular use. For instance, for underwater welding the work chamber would be constructed of, or lined with, heat resistant material.

The flotation chamber has outer side walls 16, inner side walls 18, outer end walls 20 and inner end walls 22, with a peripheral top panel 24 joining the inner and outer walls and closing the upper end of the chamber. The inner and outer walls are spaced by and the structure is reinforced by baffles 26 at suitable positions around the chamber. All of the baffles have multiple openings 28 for circulation of air and water, the flotation chamber being, in effect, a single chamber extending around the work chamber.

The flotation chamber 10 is open at the bottom to allow water to enter, while the work chamber 12 is open completely through the structure. This avoids the necessity for elaborate sealing and the structure need not be stressed to withstand high pressure, since there are no enclosed cavities.

Figure 2:
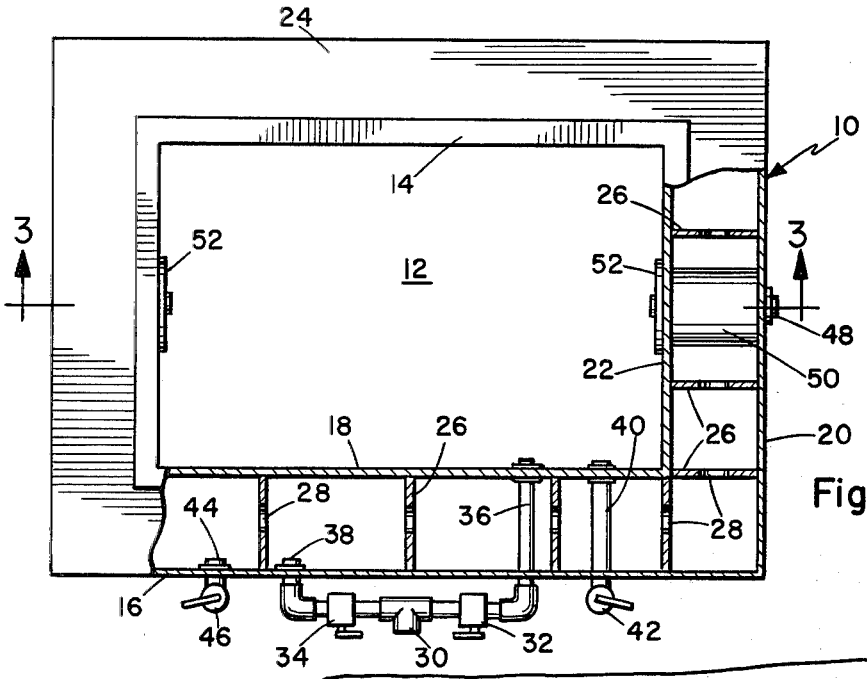
FIG. 2 is a top plan view with portions cut away.

On the upper portion of one outer side wall 16 is an inlet Tee connector 30, connected through a pair of inlet valves 32 and 34 to a work chamber inlet pipe 36 and a flotation chamber inlet pipe 38, respectively. Inlet pipe 36 extends through the inner and outer walls 16 and 18 into the top of the work chamber 12. Inlet pipe 38 passes only through outer wall 16 into the flotation chamber 10, as in FIG. 2.

In the upper portion of work chamber 10 is a relief port 40 extending through walls 18 and 16 to an external dump valve 42. In the upper portion of flotation chamber 10 is a relief port 44 leading to an external dump valve 46.

At least one end of the structure has a vent port 48 extending from the work chamber 12 to the outside of the structure. This vent port allows air to leak out of the work chamber when the water level drops to the port opening. Thus the height of the vent port above the lower edge controls the maximum depth of the air pocket which can be held in the work chamber. This ensures that a diver floating in the water in the work chamber can comfortably reach the overhead work surface, as in FIG. 3.

Figure 3:
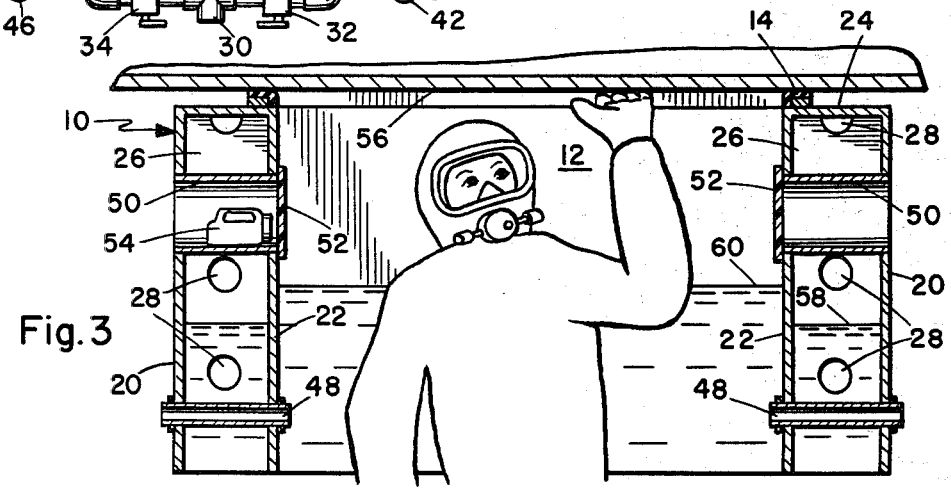
FIG. 3 is a sectional view taken on line 3—3 of FIG. 2, showing the device in use.

Also in the end wall structure, preferably at both ends as in FIG. 3, are large tubular sockets 50 extending through the walls 20 and 22. The inner end of each socket 50 is closed by a transparent window 52, sealed to inner wall 22 in any suitable manner. When working in dark areas, an underwater light 54 can be placed in any socket to illuminate the work chamber. The light holding sockets can, of course, be located at any convenient position in the structure. The arrangement provides lighting without the diver having to hold a light and without requiring electrical wiring to be run to the unit.

In use the unit is placed in the water and dump valve 46 is opened to vent the flotation chamber 10 until the unit sinks. Depending on the materials from which the unit is made, some air may be trapped in the flotation chamber by closing valve 46, to achieve a substantially neutral buoyancy. The unit is maneuvered to the work area and lifted into place against the work surface 56, as in FIG. 3.

A source of compressed air is connected to inlet Tee connector 30, either by hose from a surface compressor, or from a self-contained air bottle. Inlet valve 34 is then opened to admit air to the flotation chamber 10, until the buoyancy is sufficient to lift the unit and seal gasket 14 firmly against the work surface 56. The water level in flotation chamber 10 is indicated at 58, Inlet valve 34 is then closed to trap the flotation air. Inlet valve 32 is opened to admit air to the work chamber 12 and drive the water level 60 down to provide a suitable air pocket for the diver to work in, the valve then being closed to trap the air pocket.

If it is necessary to provide an inert gas atmosphere in the work chamber, such as for welding, a separate inlet could easily be provided.

The maximum depth of the air pocket in the work chamber is limited by the vent ports 48, which will vent air or gas when the water level drops to the vent openings. Regardless of the size of the air pocket in the work chamber, there is no load on the unit which could cause the gasket seal to be broken, since the work chamber is completely open and pressures are equalized.

To remove the unit the dump valves 42 and 46 are opened, releasing the trapped air and allowing the water to fill the compartments. The unit can then be pulled free and moved as required.

It should be noted that the work chamber can be enlarged by extending the inner walls downwardly in the form of a skirt. This would be advantageous when using inert gas in the work chamber, since the extended skirt would prevent any air bubbles from the flotation chamber from contaminating the inert gas. If it is necessary to have external indication of water levels in the chambers, it would be a simple matter to mount conventional sight glasses or tubes adjacent the valves, with appropriate connections to the individual chambers.

The unit is a very simple structure, with the control valves being the only moving parts. There are no fasteners or attachments to set up or adjust and the unit is independent of supports from the vessel or other structure being worked on. With an air bottle attached to provide fuoyancy and work chamber air, the unit is completely self-contained.

Having described my invention, I claim:

1. An underwater gas pocket work unit, comprising:

a structure having side walls with opposite first and second ends and defining a work chamber, wherein the work chamber is defined solely by the side walls to provide unobstructed access to the work chamber at both ends;

means for sealing the first end of the structure to an underwater work surface; and valve means in the structure for enabling a gas to enter the work chamber to provide a gaseous pocket in the upper portion of the work chamber when the first end of the structure is sealed to said underwater work surface.

2. An underwater gas pocket work unit according to claim 1, further comprising a means defining a vent port in at least one of the side walls more remote from the first end than the valve means, for enabling gas to flow from said gaseous pocket into the water outside the work chamber when the first end of the structure is sealed at said underwater work surface to thereby limit the maximum depth of said gas pocket to enable a workman floating at the water surface in the work chamber to comfortably reach said underwater work surface when said underwater work surface is overhead.

3. An underwater gas pocket work unit according to claims 1 or 2, wherein all of the side walls include outer side walls and inner side walls defining a flotation chamber therebetween; and wherein the unit further comprises panel means joining the inner and outer side walls and closing the end of the flotation chamber at the first end of the structure, wherein the flotation chamber is further defined by the panel means;

second valve means in at least one of the outer side walls for enabling a gas to enter the flotation chamber to provide a gaseous pocket in the upper portion of the flotation chamber when the first end of the structure is sealed to said underwater work surface.

4. An underwater gas pocket work unit according to claim 3, further comprising a connector communicating with both the first mentioned valve means and the second valve means for enabling said gas to enter both the work chamber and the flotation chamber from a common source through the connector.

5. An underwater gas pocket work unit according to claim 4, wherein the first mentioned valve means and the second valve means may be opened separately for selectively enabling gas to enter the work chamber and/or the flotation chamber respectively from said common source.

6. An underwater gas pocket work unit according to claim 3, further comprising at least one socket means in the flotation chamber for holding a light for illuminating the work chamber.

7. An underwater gas pocket work unit according to claim 6, wherein the socket means comprises a tubular member extending through the inner and outer side walls, and a transparent window sealed to the inner side wall enclosing the inner end of the tubular member.

8. An underwater gas pocket work unit according to claims 1 or 2, further comprising means connected to the side walls defining a flotation chamber;

second valve means for enabling a gas to enter the flotation chamber to provide a gaseous pocket in the upper portion of the flotation chamber when the first end of the structure is sealed to said underwater work surface; and a connector communicating with both the first mentioned valve means and the second valve means for enabling said gas to enter both the work chamber and the flotation chamber from a common source through the connector.

9. An underwater gas pocket work unit according to claim 8, wherein the first mentioned valve means and the second valve means may be opened separately for selectively enabling gas to enter the work chamber and/or the flotation chamber respectively from said common source.

10. An underwater gas pocket work unit according to claims 1 or 2 further comprising at least one socket means in at least one of the side walls for holding a light for illuminating the work chamber.

* * * * *